United States Patent [19]

Mose et al.

[11] 4,256,562

[45] Mar. 17, 1981

[54] UNITARY FILTER PRESS CELL CIRCUIT

[75] Inventors: Luciano Mose, Dortmund; Helmut Schurig, Holzwickede; Bernd Strasser, Hamm, all of Fed. Rep. of Germany

[73] Assignee: Hooker Chemicals & Plastics Corp., Niagara Falls, N.Y.

[21] Appl. No.: 40,018

[22] Filed: May 17, 1979

[30] Foreign Application Priority Data

May 19, 1978 [DE] Fed. Rep. of Germany ..... 2821985

[51] Int. Cl.[3] ..... C25B 15/08; C25B 9/00

[52] U.S. Cl. ..... 204/258; 204/266; 204/270

[58] Field of Search ..... 204/253–258, 204/267–270

[56] References Cited

U.S. PATENT DOCUMENTS

| | | | |
|---|---|---|---|
| 3,342,717 | 9/1967 | Leduc | 204/265 |
| 3,574,083 | 4/1971 | Pewitt | 204/263 X |
| 3,654,120 | 4/1972 | Messner | 204/255 |
| 3,972,796 | 8/1976 | Fröhler et al. | 204/269 |
| 4,102,754 | 7/1978 | Hedges et al. | 204/267 X |

*Primary Examiner*—T. Tung
*Assistant Examiner*—D. R. Valentine
*Attorney, Agent, or Firm*—Peter F. Casella; Howard M. Ellis

[57] ABSTRACT

A unitary filter press cell circuit is described. The circuit comprises a plurality of individual electrolytic cells mounted on a support structure positioned parallel to the longitudinal axis of the cell circuit. The longitudinal support structure is comprised of the electrolyte inlet conduits for the cell circuit and the electrolysis product outlet conduits for the cell circuit. The composite unit, cells and support structure, may be moved as a single unit, suitably by hoisting, facilitating the removal from service of a faulty circuit and the subsequent substitution with a replacement circuit. The longitudinal support structure is suitably comprised of conduits or headers for catholyte, anolyte, the anodic products and the cathodic products of the cells in the circuit. Although the conduits may be round or oval in cross-section, conduits of a rectangular cross-section are preferred. In a preferred embodiment, the conduits for the anodic and cathodic products, mixtures of gases and liquids, are preferably of a larger capacity than required for the passage of solely liquid products, thus facilitating a separation of the gaseous and liquid products within the conduit. For example, in the case of the electrolysis of sodium chloride, wherein the anodic product from the individual cells is chlorine gas and aqueous sodium chloride and the cathodic product is hydrogen and an aqueous sodium hydroxide solution, the larger capacity of the cell product outlet conduits facilitates separation of the chlorine product from the brine solution and the hydrogen product from the caustic solution.

8 Claims, 3 Drawing Figures

UNITARY FILTER PRESS CELL CIRCUIT

BACKGROUND OF THE INVENTION

The present invention relates to an improved arrangement of electrolytic cells of the filter press type. More particularly, the present invention relates to a unitary arrangement of filter press cells in a circuit wherein the circuit has a common support structure positioned beneath the circuit which includes the electrolyte feed and the electrolysis products collection conduits. Electrolytic cells are particularly useful in the electrolysis of alkali metal chlorides, such as sodium choride, to produce alkali metal hydroxides, such as sodium hydroxide, together with chlorine and hydrogen.

A filter press arrangement typically consists of a plurality of separate cell units having planar electrode elements generally mounted in a vertical position separated along their active faces by a barrier, such as a diaphragm or membrane layer. The filter press cell units may be monopolar or bipolar and may be appropriately connected in series or parallel to form a cell circuit or bank.

Chlorine and alkali metal hydroxides are essential and large volume commodities as basic industrial chemicals. Plants producing 500 to 1000 tons of chlorine per day are not uncommon. Such plants typically utilize a large number of individual electrolytic cells having current capacities of several hundred thousand amperes. Thus, minor improvements in individual cell operation or performance have major economic benefits because of the volume of the products produced.

Upon the application of direct, electrolyzing current to an electrolytic cell containing an aqueous solution of an alkali metal chloride as the electrolyte, hydrogen and alkali metal hydroxide are produced at the cathode and chlorine is produced at the anode.

Electrolytic cells that are commonly employed commercially for the conversion of alkali metal halides into alkali metal hydroxides and halides may be considered to fall into the following general types: (1) diaphragm, (2) mercury and (3) membrane cells.

Diaphragm cells utilize one or more diaphragms permeably to the flow of electrolyte solution but impervious to the flow of gas bubbles. The diaphragm separates the cell into two or more compartments. Although diaphragm cells achieve relatively high product per unit floor space, at low energy requirements and at generally high current efficiency, the alkali metal hydroxide product, or cell liquor, must be concentrated and purified. Such concentration and purification is usually accomplished by a subsequent evaporation step.

Mercury cells typically utilize a moving or flowing bed of mercury as the cathode and produce an alkali metal amalgam in the mercury cathode. Halide gas is produced at the anode. The amalgam is withdrawn from the cell and treated with water to produce a high purity alkali metal hydroxide.

Membrane cells utilize one or more membranes or barriers separating the catholyte and the anolyte compartments. The membranes are permselective, that is, they are selectively permeably to either anions and cations. Generally, the permselective membranes utilized are cationically permselective. Usually, the catholyte product of the membrane cell is a relatively high purity alkali metal hydroxide ranging in concentration from about 250 to about 350 grams per liter.

The advent of dimensionally stable anodes has permitted ever narrowing of the space, or gap, between the electrodes of a cell, thereby facilitating progressively higher cell efficiency. The advent of dimensionally stable anodes and suitable membrane materials has made possible the construction of electrolytic cells having a thin separating partition positioned between planar electrodes, and the combination of a number of individual cell units, usually between about 10 and about 100, to form a cell circuit or bank arranged in the manner of a filter press. Circuits or banks of filter press cells are formed by the assembly of individual cell components. For example, in the case of a monopolar arrangement, the components typically would comprise a plurality of anodes mounted in anode frames and cathode mounted in cathode frames. The anodes and cathodes are separated along their active faces by a permeably barrier, such as a diaphragm or membrane, forming an anolyte compartment and a catholyte compartment, and along the inner periphery of their frames by a pliable or elastic gasket member. The assembly is completed by coupling or pressing the components together, hydraulically or by means of threaded connectors, to compress the gasket members to form gas and liquid-tight seals between the individual units.

In a typical electrolysis operation employing a circuit of filter press cells to electrolyze sodium chloride, an anolyte feed, an aqueous solution of brine containing between about 100 and about 310 grams per liter sodium chloride, is introduced into each of the anolyte compartments, and a catholyte, water or a recirculating solution of sodium hydroxide, is introduced into each of the catholyte compartments. When an electrolyzing source of direct current is imposed on the circuit, chlorine is formed at the anodes and is removed from the anolyte compartments through suitable vents or ports, along with a portion of the brine, and fed into a common collector conduit along with the anodic products from other cells in the circuit. Hydrogen and sodium hydroxide formed by migration of hydroxyl ions through the barrier member, are removed from the catholyte compartments through suitable vents or ports and fed into a separate common collector conduit along with the cathodic products from other cells in the circuit.

The present invention provides a means of support beneath a cell circuit which is combined with the various feed and product conduits. The present unitary circuit may be removed from service for repair by making suitable electrical connection around the circuit and disconnecting only the feed and product connections for the circuit. The circuit may then be lifted as a unit and replaced by a similar circuit.

GENERAL DESCRIPTION OF THE INVENTION

The present invention provides a unitary circuit of filter press electrolytic cells which comprises a plurality of individual electrolytic cells mounted on a support structure positioned parallel to the longitudinal axis of the cell circuit. The longitudinal support structure is comprised of the electrolyte inlet conduits for the cell circuit and the electrolysis product outlet conduits for the cell circuit. The composite unit, cells and support structure, may be moved as single unit, suitably by hoisting, facilitating the removal from service of a faulty circuit and the subsequent substitution with a replacement circuit. The longitudinal support structure is suitably comprised of conduits or headers for catholyte, anolyte, the anodic products and the cathodic products of the cells in the circuit. Although the conduits may be round or oval in cross-section, conduits of a rectangular cross-section are preferred. In a preferred embodiment, the conduits for the anodic and cathodic products, mixtures of gases and liquids, are preferably of a larger capacity than required for the passage of solely liquid products, thus facilitating a separation of the gaseous and liquid products within the conduit. For example, in the case of the electrolysis of sodium chloride, wherein the anodic product from the individual cells is chlorine gas and aqueous sodium chloride and the cathodic product is hydrogen and an aqueous sodium hydroxide solution, the larger capacity of the cell product outlet conduits facilitates separation of the chlorine product from the brine solution and the hydrogen product from the caustic solution.

DETAILED DESCRIPTION OF THE INVENTION

The present invention will now be described more in detail by reference to the accompanying drawings.

FIGS. 1 and 3 of the drawings are illustrative of the present invention and are not to be construed as limiting the invention to the particular mode shown.

Figure 1:
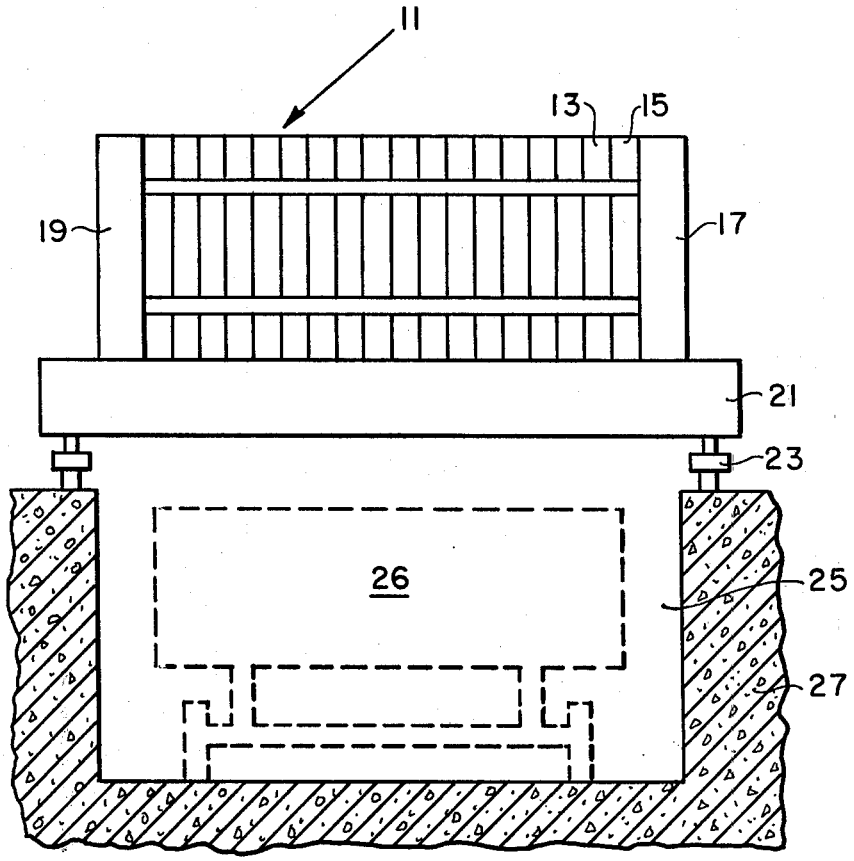
FIG. 1 is a side view, partly in section, of a unitary cell circuit of the present invention positioned as it would be in service.

Looking now at FIG. 1, a filter press cell circuit, generally indicated by 11, is comprised of a plurality of anode and cathode frame members, such as 13 and 15, positioned between end support members 17 and 19. The anode and cathode frame members house, appropriately, anode members and cathode members which have a barrier, such as asbestos or membrane, separating their active faces. The frames are suitably pressed together with a gasket material therebetween to form individual electrolytic cell units. The arrangement may be monopolar or bipolar, and an appropriate source of direct current suitable to decompose or electrolyze the electrolyte is connected to the circuit. The number of cells in a cell circuit is not critical; however, for practical operations the number is generally between about 10 and about 100.

The anode members may be foraminous or in the form of a sheet or plate and are preferably fabricated from a valve metal base which has an electrically-conductive, anodically-resistant coating applied to its active anodic or unoxidized surface. Suitably valve metals include titanium, tantalum, niobium and zirconium. The preferred valve metal is titanium. The coating preferably contains one or more platinum-group metals and/or platinum-group metal oxides. Suitably platinum-group metals include platinum, ruthenium, rhodium, palladium, osmium and iridium. Any of various methods can be used for applying the coating to the valve metal base. Typical methods include precipitation of the metals or metallic oxides by chemical, thermal or electrolytic processes, ion plating, vapor deposition or the like means.

Cathode members are suitably fabricated of steel; however, chromium, cobalt, copper, iron, lead, molybdenum, nickel, tin, tungsten or alloys thereof also can be used. The cathode members may also be foraminous or may be in the form of a sheet or plate.

Suitable membranes may be fabricated of a hydrolyzed copolymer of a perfluorinated hydrocarbon and a sulfonated perfluorovinyl ether. More specifically, such suitable membrane materials are fabricated of a hydrolyzed copolymer of tetrafluoroethylene and a fluorosulfonated perfluorovinyl ether of the formula: $FSO_2CF_2CF_2OCF(CF_3)CF_2OCF{=}CF_2$. Usually, the membrane wall thickness will range from about 0.02 to about 0.5 mm. and, preferably, from about 0.1 to about 0.3 mm. When mounted on polytetrafluoroethylene, asbestos or other suitably network for support, the network filaments or fibers will generally have a thickness of from about 0.01 to about 0.5 mm. and, preferably, from about 0.05 to about 0.15 mm.

Frame members, such as 13 and 15, and end members 17 and 19 are mounted on rigid support structure 21 positioned parallel to the longitudinal axis of circuit 11. The unit, cells and support structure, rests on insulating and adjustable feet 23 and is suitably positioned over pit 25 in foundation 27. A movable bus bar, or bridge, 26, shown in outline, is provided in pit 25 to provide a path for electrical current to adjoining circuits when a unitary cell circuit, such as 11, is removed from service for repair. The use of such movable bus bar, or bridge, is described in detail in U.S. Pat. No. 3,930,978.

Figure 2:
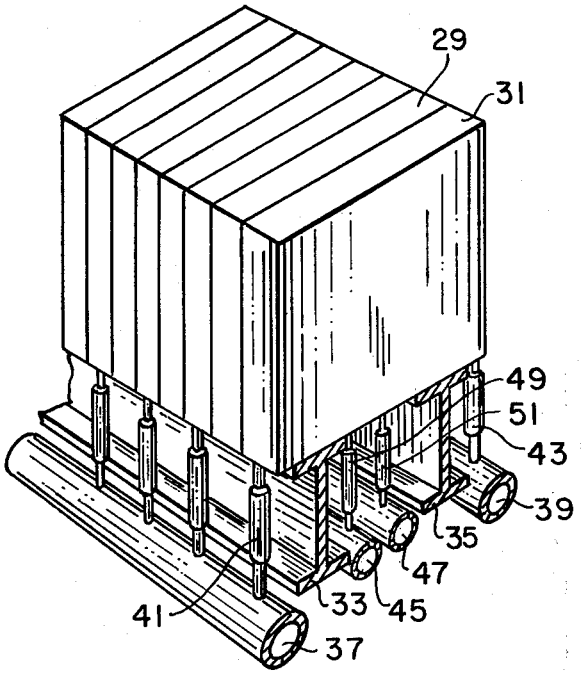
PRIOR ART FIG. 2
FIG. 2 is a schematic perspective view of a prior art cell having a separate base supporting means.

FIG. 2 shows a prior art means of providing a unitary cell circuit of filter press cells. In the arrangement shown in FIG. 2, cell frames, such as 29 and 31, comprise filter press cells which make up the cell circuit. The cell frames are positioned atop longitudinal "I" beams 33 and 35. Electrolysis product outlet conduits 37 and 39 are connected to appropriate outlets in the frame members by connections, such as 41 and 43. Electrolyte inlet conduits 45 and 47 are connected to appropriate frame inlets by connections, such as 49 and 51. A filter press cell circuit arrangement such as that shown in FIG. 2 is described in West German Offenlegungsschrift No. 2,551,234.

Figure 3:
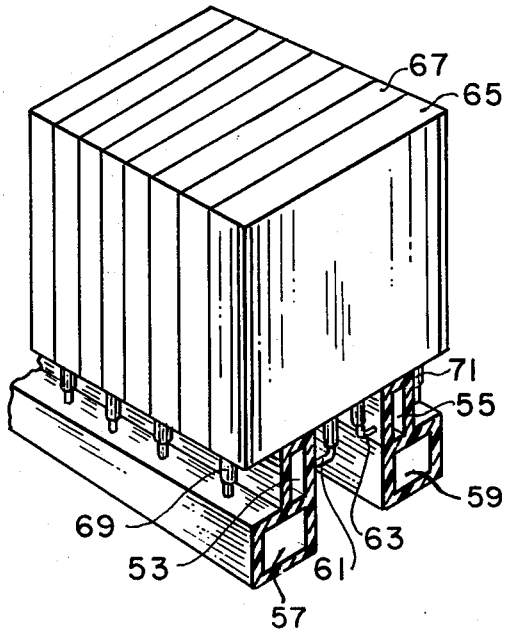
FIG. 3 is a schematic perspective view of the unitary cell circuit of the present invention.

FIG. 3 shows the present invention wherein the longitudinal circuit support structure is comprised of the electrolyte inlet conduits and the electrolysis product outlet conduits. The electrolyte inlet conduits include at least one anolyte feed conduit, such as 53, and at least one catholyte feed conduit, such as 55. The cell electrolysis product conduits include at least one anodic product outlet conduit, such as 57, and at least one cathodic product outlet conduit, such as 59. The electrolyte conduits, such as 53 and 55, are communicatively connected to individual cell units by pipe connections, such as 61 and 63, through appropriate frame members, such as 65 and 67. Electrolysis product conduits, such as 57 and 59, are communicatively connected to individual cell units by pipe connections, such as 69 and 71, through appropriate frame members, such as 65 and 67.

The longitudinal conduit support structure is preferably comprised of two pairs of conduits arranged along a side of the cell circuit with one pair positioned contiguous to one outside edge and the other pair positioned contiguous to the remaining outside edge. Preferably, the longitudinal support structure is positioned beneath, along the bottom of, the cell circuit, facilitating stability in lifting and cohesiveness of the unit, by pipe connections, such as 61, 63, 69 and 71. Electrolysis product outlet conduits 57 and 59 are preferably of a size greater than that required to carry only the liquid electrolysis products to provide a means of separating the gaseous and liquid products while in the conduit. The conduits are preferably rectangular in cross-section; however, conduits of circular or oval cross-section, or various combinations, may be utilized. If conduits of oval cross-section are utilized as the electrolysis product outlet conduits, it is preferred that the narrow sides of the oval cross-section be positioned vertically to provide overhead space for gas-liquid separation in the conduits.

The conduits are fabricated of material which lend rigidity to the unitary cell circuit support and are preferably metallic. The conduit materials are corrosion-resistant in the environment of their use. Thus, the anolyte inlet and anodic cell product conduits are suitably fabricated of a metal, such as titanium, and the catholyte inlet and cathodic product conduits are suitably fabricated of a metal, such as steel. The circuit supporting structure may be comprised of metal conduits having their interior, or portions exposed to electrolyte and electrolysis products, coated with a corrosion-resistant resin material, for example, polypropylene, polybutylene, polytetrafluoroethylene, or chlorendic acid based polymers, or with a corrosion-resistant elastomeric material, such as hard rubber.

While there have been described various embodiments of the invention, the apparatus described is not intended to be understood as limiting the scope of the invention as it is realized that changes therewithin are possible, and it is intended that each element recited in any of the following claims is to be understood as referring to all equivalent elements for accomplishing the same results in substantially the same or equivalent manner, it being intended to cover the invention broadly in whatever form its principle may be utilized.

What is claimed is:

1. In a filter press type electrolytic cell comprising a plurality of electrolytic cell units with separators forming anolyte and catholyte compartments, said compartments housing vertically mounted planar electrode elements wherein the cell units are mounted on a rigid, non-hollow longitudinal support the improvement comprising, the cell units mounted atop a support structure consisting of a combination of both electrolyte inlet conduits and electrolysis product outlet conduits, said support structure being exterior to and non-integral with the cell units, but directly connected by individual conduit means to individual anolyte and catholyte compartments of said cell units.

2. The unitary circuit of claim 1 wherein said plurality of cells numbers between 10 and 100.

3. The unitary circuit of claim 1 wherein said conduits are rectangular in cross-section.

4. The unitary circuit of claim 1 wherein the support structure includes an anolyte feed conduit, a catholyte feed conduit, and anodic cell product outlet conduit, and a cathodic product outlet conduit.

5. The unitary circuit of claim 4 wherein the anolyte feed and anodic cell product conduits are fabricated of titanium.

6. The unitary circuit of claim 4 wherein the catholyte feed and cathodic cell product conduits are fabricated of steel.

7. The unitary circuit of claim 4 wherein the support structure is metal and the interior of the conduits are coated with corrosion-resistant resin material.

8. The unitary circuit of claim 4 wherein the support structure is metal and the interior of the conduits are coated with a corrosion-resistant rubber.

* * * * *